United States Patent [19]

Rosow

[11] 3,973,522

[45] Aug. 10, 1976

[54] ANIMAL HOLDER FRAME MEANS

[76] Inventor: Carl Rosow, 66 Dana St., Cambridge, Mass. 02138

[22] Filed: May 23, 1975

[21] Appl. No.: 580,151

[52] U.S. Cl. ..... 119/103
[51] Int. Cl.[2] ..... A61D 3/00
[58] Field of Search ..... 119/103, 96, 156, 160

[56] References Cited

UNITED STATES PATENTS

| | | | |
|---|---|---|---|
| 3,094,101 | 6/1963 | Porter | 119/103 |
| 3,103,204 | 9/1963 | Greene | 119/103 |
| 3,442,255 | 5/1969 | Berkowitz | 119/103 |

*Primary Examiner*—Hugh R. Chamblee
*Attorney, Agent, or Firm*—Munroe H. Hamilton

[57] ABSTRACT

An animal holder frame for use with mice, rats and other long-tailed animals used in laboratory experimentation includes a horizontally disposed supporting base section on which an animal may stand or crouch. At one side of the base is vertically disposed a rack member formed with aperture means of a size suitable for admitting an animal's tail, perineum and gluteal regions. Peg means horizontally disposed in the rack in a position immediately adjacent to the outer side of the aperture means provides holding means to which the tail of an animal may be taped or otherwise detachably secured.

2 Claims, 4 Drawing Figures

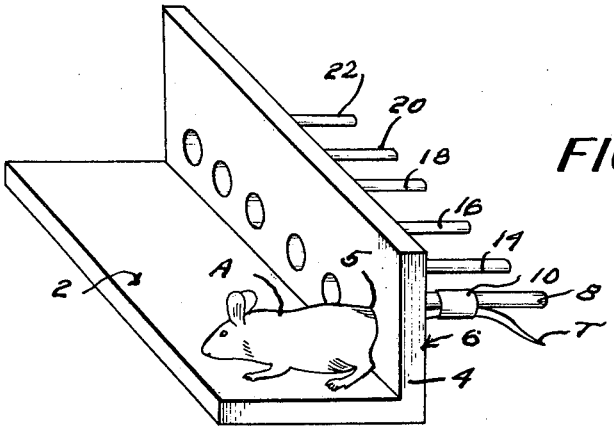
FIG. 1
FIG. 2
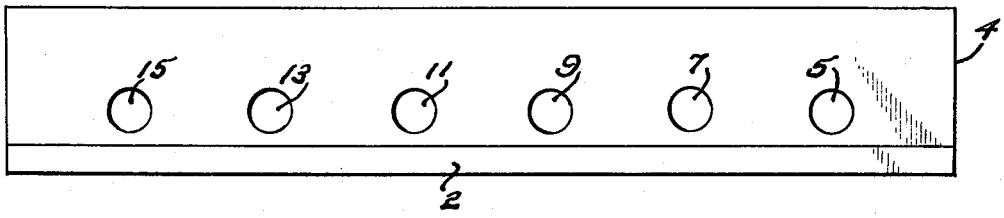
FIG. 3
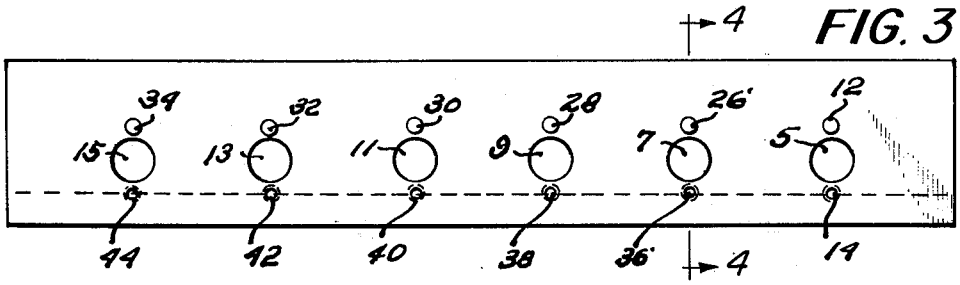
FIG. 4
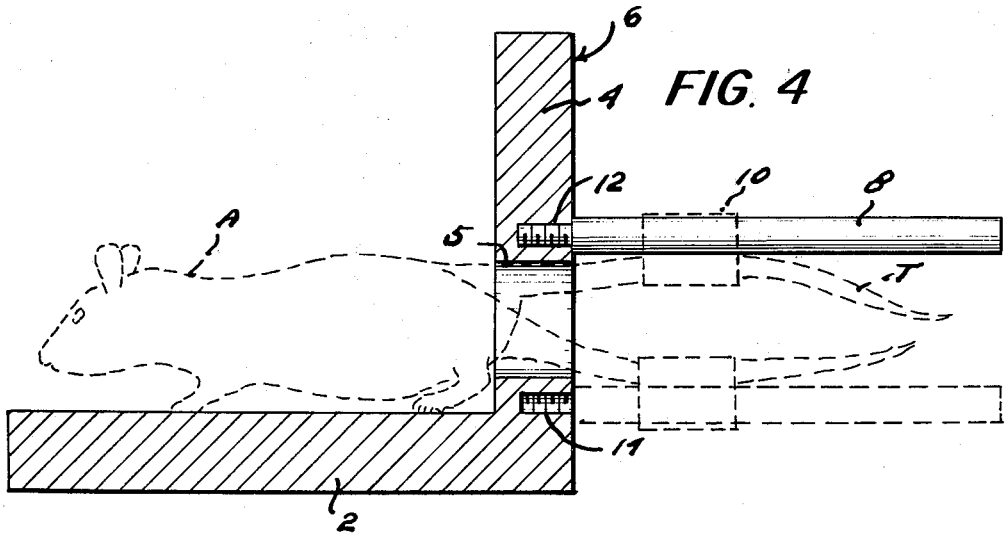

ANIMAL HOLDER FRAME MEANS

BACKGROUND OF THE INVENTION

In the art of laboratory experimentation with mice and rats, monitoring of body temperature is carried out by means of rectal thermistor probes. Repeated insertion of such probes will elevate temperature and therefore use of chronically indwelling probes is preferable. In this situation, the animals must be restrained less they injure themselves or destroy the equipment. To accomplish this, it is now customary to employ commonly available restraint apparatus of various types, all of which are understood to be of a construction designed to constitute an enclosure body such as a box, cylinder or the like in which an animal may be confined. It has been found, however, that confining an animal in this way in an enclosure body is undesirable as it seriously interferes with normal thermoregulatory behavior.

SUMMARIZATION OF THE INVENTION

The present invention is concerned with improved animal restraining apparatus for holding mice and rats during laboratory experimentation. More particularly the invention relates to a holding frame which is designed to secure an animal in a satisfactory manner for accurately monitoring body temperature, and it is a chief object of the invention to devise a holding frame in which an animal may be held without being confined in an enclosure body in a manner which interferes with normal thermoregulatory behavior.

With this objective in mind, I have devised a holding frame construction in which a laboratory animal may be held without experiencing significant inhibitions affecting thermoregulatory behavior. An important feature of the holding frame structure is the combination of a vertical rack element with an open base member on which an animal may stand or crouch without being confined or in any way enclosed by surrounding wall surfaces. The rack member includes an apertured section and peg means to which an animal's tail received through the apertured section may be detachably secured.

BRIEF DESCRIPTION OF THE DRAWINGS

FIG. 1 is a perspective view of the animal holding frame of the invention with a laboratory animal secured therein in a desired position.

FIG. 2 is a front elevational view of the holding frame.

FIG. 3 is a rear elevational view of the holding frame.

FIG. 4 is a cross section taken on the line 4—4 of FIG. 3.

DETAILED DESCRIPTION OF THE INVENTION

Referring more in detail to the drawings, FIG. 1 illustrates one preferred embodiment of animal holder frame means in which is provided a base section 2 formed of metal, plastic or other desired material. In this preferred embodiment the base is constructed of a width suitable for providing a supporting surface on which an animal such as a mouse or rat may stand or crouch, as illustrated diagrammatically by the animal denoted by the arrow A in FIG. 1. It is contemplated that a number of experimental animals may be supported on the base 2 in side by side relationship and the base may, therefore, be of an elongated shape as shown in the drawings.

Along one side of the base section 2 is located rack means 4 which may, for example, consist in an upright wall structure formed with aperture means as 5 through which the tail of the laboratory animal A may be received. In the preferred form shown, the aperture means may be of a size for admitting not only the tail, but also the perineum and gluteal regions of the animal as well, as has been suggested in FIG. 1.

Rigidly supported at the outer side 6 of the wall structure 4, in a horizontally disposed position is a retainer rod element 8, and as is more clearly shown in FIG. 4, the placement of the rod 8 is in a threaded hole 12 located in the wall structure closely adjacent to, and directly above, the aperture 5. In this position, the top or upper back section of the tail portion T of the animal A may be located against the rod 8 in dorsally disposed relationship and releasably held by some suitable fastening means such as an adhesive tape element 10 or other suitable clamping means.

As is also shown in FIG. 4, wall structure 4 may be further formed with a threaded opening 14 into which the threaded end of the rod 8 may also be detachably secured when desired. The opening 14 is located immediately below the aperture 5 as best shown in FIG. 3. When the rod 8 is threaded into the opening 14, as suggested in broken lines in FIG. 4, the underside of the tail T of animal A may be fastened to the rod 8 in ventrally secured relationship.

In a similar manner, a plurality of apertures as 7, 9, 11, 13 and 15 may be formed in the wall structure 4. Likewise, a plurality of additional rod elements as 14, 16, 18, 20 and 22 may be detachably secured in the member 4. These rods may be threaded into respective openings 26, 28, 30, 32 and 34 or alternatively in lower threaded openings 36, 38, 40, 42 and 44.

Provision for arranging the rods alternatively in either upper or lower respective threaded openings is useful in carrying out this type of experimental work in a laboratory. For example, in making temperature studies, the area of concern is beneath the tail, and therefore the thermistor is inserted and tied with the tail in dorsally located relationship to the rod. If on the other hand, examination of the tail itself, as for example, a tail vein injection is to be carried out, the more convenient position is to locate the underside of the tail in ventrally disposed relationship to the rod.

It is understood that the invention may be varied in several respects. For example, the rack member may be of a construction other than a solid wall or partition as, for example, a plurality of spaced upright portions between which the animal's tail may be secured. Likewise, the use of an adhesive tape may be replaced by various clamping devices of well-known nature. It is intended that the rack structure may be formed with the rod members occurring as integrally formed projecting parts. I may also desire to provide partitions to separate animals from one another for some experimental procedures.

I claim:

1. An animal holder frame for supporting and restraining laboratory mice and rats during laboratory experimentation, said frame including a supporting base section on which an animal may stand or crouch, rack means comprising a vertically disposed wall located along one side of the base section, said vertically disposed wall being formed with aperture means suitable for admitting an animal's tail, perineum and gluteal regions, retainer rod means horizontally disposed at the outer side of the wall in close proximity to the aperture means to provide an anchoring surface to which the animal's tail may be attached, and said rod means being located immediately above the aperture means in a position to hold an animal's tail in dorsally secured relationship.

2. The invention of claim 1 in which the retainer rod means and aperture means include a plurality of said rods and apertures located in spaced apart relation along the said vertically disposed wall.

* * * * *